US005909726A

United States Patent [19]

Kobayashi et al.

[11] Patent Number: 5,909,726

[45] Date of Patent: Jun. 8, 1999

[54] FUEL CONTROL SYSTEM FOR AUTOMOBILE ENGINE

[75] Inventors: Hideki Kobayashi, Hiroshima; Hideki Kusunoki, Ehime, both of Japan

[73] Assignee: Mazda Motor Corporation, Hiroshima, Japan

[21] Appl. No.: 08/879,026

[22] Filed: Jun. 19, 1997

[30] Foreign Application Priority Data

Jun. 20, 1996 [JP] Japan ..... 8-160023
Feb. 6, 1997 [JP] Japan ..... 9-149600

[51] Int. Cl.[6] ..... F02M 37/04

[52] U.S. Cl. ..... 123/520; 123/516

[58] Field of Search ..... 123/520, 519, 123/521, 518, 516, 198 D, 357

[56] References Cited

U.S. PATENT DOCUMENTS 5,355,862 10/1994 Muramatsu ..... 123/520
5,469,832 11/1995 Nemoto ..... 123/520
5,535,719 7/1996 Morikawa ..... 123/520
5,676,118 10/1997 Saito ..... 123/520
5,680,849 10/1997 Morikawa ..... 123/520
5,682,863 11/1997 Kadooka ..... 123/520
5,746,187 5/1998 Ninomiya ..... 123/520
5,765,541 6/1998 Farmer ..... 123/520

FOREIGN PATENT DOCUMENTS 5-202815 8/1993 Japan .
6-323179 11/1994 Japan .

*Primary Examiner*—Carl S. Miller
*Attorney, Agent, or Firm*—Sixbey, Friedman, Leedom & Ferguson; Donald R. Studebaker

[57] ABSTRACT

A fuel control system for feedback controlling a purge gas flow rate as well as an air-to-fuel ratio which learns the concentration of fuel of a purge gas based on an average of air-to-fuel ratio control values at adjacent reversal there of between an upward tendency and a downward tendency and determines the content of fuel of the purge gas based on the purge gas concentration by which the amount of fuel delivered by an injector is reduced.

23 Claims, 10 Drawing Sheets

FUEL CONTROL SYSTEM FOR AUTOMOBILE ENGINE

BACKGROUND OF THE INVENTION

1. Field of the Invention

This invention relates to a fuel control system for an automobile engine, in particular an automotive vehicle engine having an air intake system into which fuel vapors are purged for feedback controlling an air-to-fuel ratio to maintain a stoichiometric air-fuel mixture.

2. Description of Related Art

Typically, fuel systems for engines, especially automotive vehicle engines, feedback control an air-to-fuel ratio by use of an oxygen ($O_2$) sensor to maintain a stoichiometric air-fuel mixture.

On the other hand, it is typical for such an automotive vehicle engine to purge fuel vapors into an air intake system of the engine. The fuel vapors are usually stored in a canister and drawn into a surge tank forming part of the air intake system where they are mixed with fuel for burning whenever a prescribed purge execution condition is satisfied. A purge valve, provided between the canister and the air intake system, is controlled to open, permitting the fuel vapors to be drawn into the air intake system together with fresh air introduced into the canister. Such fuel vapor purge control is known from, for example, Japanese Unexamined Patent Publication No. 5-202815.

Purge gas introduced into the engine is a mixture of fuel vapors and air, and hence, when purging the fuel vapors together with performing the air-to-fuel ratio feedback control, it is necessary to subtract the amount of fuel vapors contained in the purge gas from the amount of fuel injected by an fuel injection valve. In order to determine the concentration of fuel in the purge gas, it is popular to learn the concentration of fuel in the purge gas based on an air-to-fuel ratio feedback control value in the air-to-fuel ratio control. In some types of fuel concentration learning, the learning gain in the purge gas concentration learning control is altered between when the air-to-fuel ratio feedback control value increases and when it decreases. Such fuel concentration learning is known from, for instance, Japanese Unexamined Patent Publication No. 6-323179.

When utilizing air-to-fuel ratio feedback control values to learn the concentration of fuel in a purge gas, the air-to-fuel ratio feedback control value serves as a parameter indicating a deviation of an air-to-fuel ratio from an ideally combustible or target air-to-fuel ratio for maintaining the stoichiometric air-fuel mixture. Specifically, the learned concentration of fuel in a purge gas is increased correspondingly to the learning gain if the air-to-fuel ratio feedback control value is on a side enriching the air-fuel mixture or decreased correspondingly to the learning gain if the air-to-fuel ratio feedback control value is on a side making the air-fuel mixture lean.

In the fuel control system for monitoring an actual air-to-fuel ratio and an air-to-fuel ratio feedback control value, there is a time-phase difference of, for example, approximately $\pi/2$ between them due to a time lag between fuel injection through a fuel injection valve and response of an oxygen ($O_2$) sensor to a burnt gas. Consequently, inaccuracy of the concentration of fuel in a purge gas is encountered by direct use of an air-to-fuel ratio feedback control value as a parameter indicating a deviation of an air-to-fuel ratio from a target air-to-fuel ratio results, which is always undesirable for the precise air-to-fuel ratio control.

SUMMARY OF THE INVENTION

It is accordingly an object of the invention to provide a fuel control system for an automobile engine which determines precisely a deviation of an actual air-to-fuel ratio from a target air-to-fuel ratio based on an air-to-fuel ratio feedback control value and performs the air-to-fuel ratio feedback control with a high accuracy.

The foregoing object of the invention is accomplished by providing a fuel control system for an automobile engine which executes air-to-fuel ratio feedback control to control the amount of fuel delivered to the engine based on an air-to-fuel ratio feedback control value, which is decreased according to an air-to-fuel ratio deviation of an actual air-to-fuel ratio from the target air-to-fuel ratio, such as an ideally combustible air-to-fuel ratio for a stoichiometric air-fuel mixture, when the actual air-to-fuel ratio is on a rich side and increased according to the air-to-fuel ratio deviation when the actual air-to-fuel ratio is on a lean side, so as to deliver a target air-to-fuel ratio. The fuel control system utilizes an absolute air-to-fuel ratio feedback control value smaller than an absolute value of the air-to-fuel ratio control value at a point of time of reversal between a downward tendency and an upward tendency of the air-to-fuel ratio feedback control value as an attributive value to the air-to-fuel ratio deviation, and determines a fuel control value for controlling the amount of fuel delivered to the engine based on the attributive value.

According to another aspect of the invention, the fuel control system determines an air-to-fuel ratio deviation of an actual air-to-fuel ratio from a target air-to-fuel ratio based on an attributive value to a change of an air-to-fuel ratio feedback control value until reversal between a downward tendency and an upward tendency of the air-to-fuel ratio feedback control value, and also determines a fuel control value for controlling the amount of fuel delivered to the engine based on the air-to-fuel ratio deviation.

According to a further aspect of the invention, the fuel control system determines an air-to-fuel ratio deviation of an actual air-to-fuel ratio from a target air-to-fuel ratio based on an air-to-fuel ratio feedback control values at adjacent reversal of between a downward tendency and an upward tendency of the air-to-fuel ratio feedback control value, controls a purge valve between an intake system and a fuel tank to deliver a target rate of a purge gas into the intake system, determines the concentration of fuel of the purge gas based on the air-to-fuel ratio deviation and the content of fuel of the purge gas based on the target rate of the purge gas and the concentration of fuel of the purge gas, and decreases the amount of fuel delivered to the engine by the content of fuel of the purge gas.

With the fuel control system of the invention, because the utilization is made of an absolute air-to-fuel ratio feedback control value smaller than an absolute value of the air-to-fuel ratio control value at a point of time of reversal between a downward tendency and an upward tendency of the air-to-fuel ratio feedback control value as an attributive value to the air-to-fuel ratio deviation, it is prevented or significantly reduced an occurrence of hunting of the air-to-fuel ratio feedback control value due to a time-difference in phase between the actual air-to-fuel ratio and the air-to-fuel ratio feedback control value which always causes an adverse effect to delivering the target air-to-fuel ratio.

In cases where the fuel control system controls the amount of a purge gas delivered into an intake system of the engine during execution of the air-to-fuel ratio feedback control, the concentration of fuel of the purge gas and the fuel control value may be estimated based on the attributive value and on the concentration of fuel of the purge gas, respectively. In such a case, the air-to-fuel ratio feedback control is precisely performed due to consideration of the content of fuel of a purge gas precisely determined.

Attributive value to a deviation of an air-to-fuel ratio from a target air-to-fuel ratio may be determined based on a value attributive to a change in the air-to-fuel ratio feedback control value between adjacent reversal between a downward tendency and an upward tendency of the air-to-fuel ratio feedback control value. Further, the attributive value to a deviation of an air-to-fuel ratio from a target air-to-fuel ratio may take an average of air-to-fuel ratio feedback control values before reversal between a downward tendency and an upward tendency thereof. Because the attributive value is determined in consideration of a time-difference between the air-to-fuel ratio and the air-to-fuel ratio feedback control value, the air-to-fuel ratio feedback control is precisely performed with an accurate fuel control value for the content of fuel of a purge gas determined based on the attributive value with an effect of preventing or significantly reducing hunting of the air-to-fuel ratio. The utilization of an average air-to-fuel ratio feedback control value makes the attributive value accurate and makes it easy to monitor how the air-to-fuel ratio feedback control value changes between adjacent reversal between a downward tendency and an upward tendency thereof.

Attributive value to a deviation of an air-to-fuel ratio from a target air-to-fuel ratio may be set to a fixed value when an actual air-to-fuel ratio is on a rich side providing a rich air-fuel mixture or on a lean side providing a lean air-fuel mixture. In a period of time for enriching an air-fuel mixture or for rarefying an air-fuel mixture, a change in the concentration of fuel to be delivered is suppressed.

Concentration of fuel of the purge gas may be estimated based on the attributive value to a deviation of an air-to-fuel ratio from a target air-to-fuel ratio after rarefying the purge gas based on the attributive value when the attributive value is greater than an upper specified level or after enriching the purge gas based on the attributive value when the attributive value is less than a lower specified level. Further, the concentration of fuel of the purge gas may be estimated based on the attributive value without changing the purge gas when the attributive value is between the upper specified level and the lower specified level. These are favorable for stable execution of the air-to-fuel ratio feedback control.

A fuel concentration learning gain may be changed according to the attributive value to a deviation of an air-to-fuel ratio from a target air-to-fuel ratio, which provides an improved reliability of the learning value and accelerates a renewal of the learning value.

BRIEF DESCRIPTION OF THE DRAWINGS

The above and other objects and features of the present invention will be understood from the following description of a specific embodiment thereof when considering in conjunction with the accompanying drawings, in which.

DETAILED DESCRIPTION OF THE SPECIFIC EMBODIMENT

Figure 1:
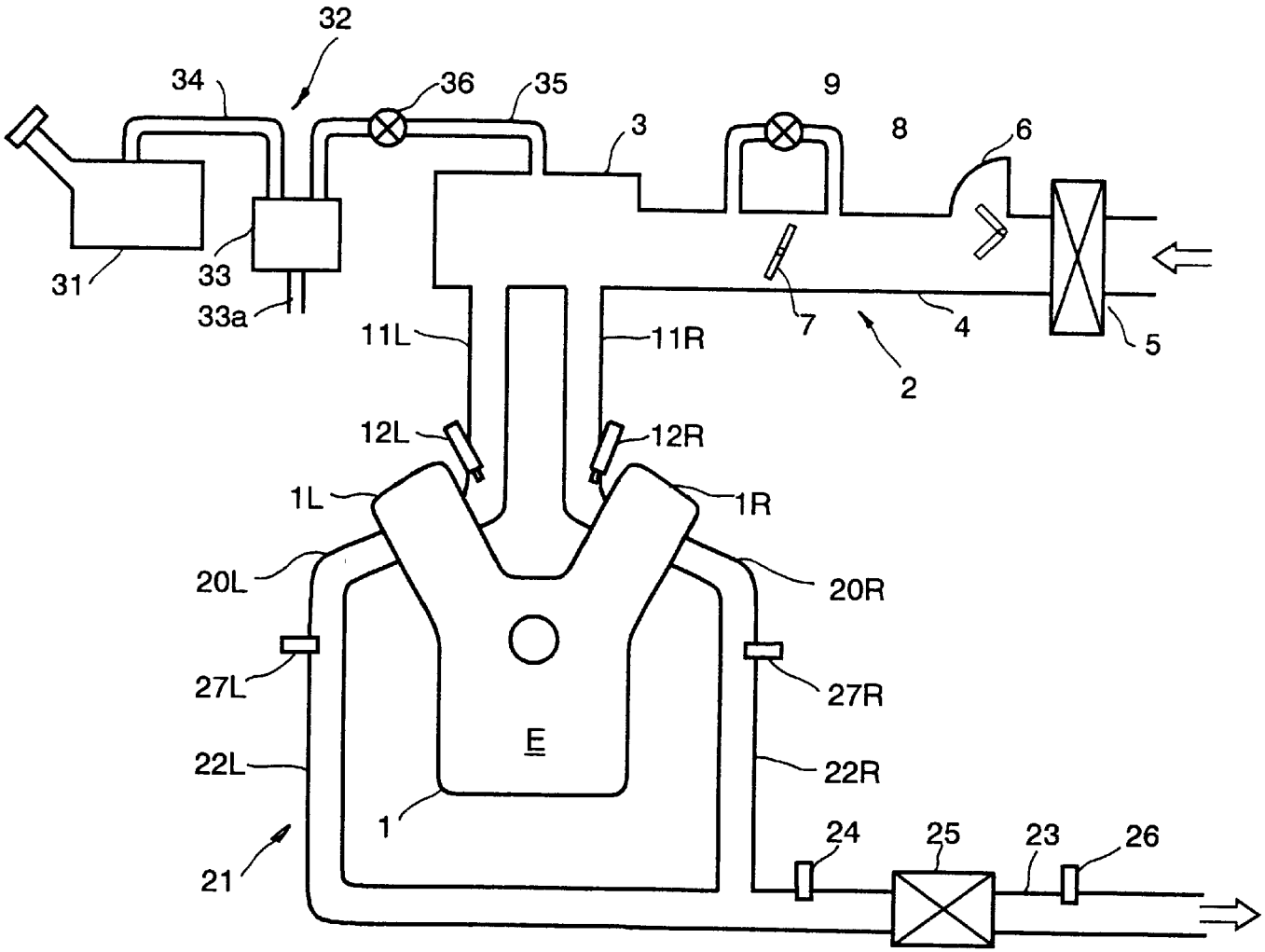
FIG. 1 is a schematic illustration of an engine and a fuel system which are controlled by a fuel control system of the invention.

Referring to the drawings in detail, particularly to FIG. 1 which shows an engine, for example a six-cylinder V-type engine, including a fuel system controlled by a fuel control system of the invention, an engine body E of the engine 1 comprises left and right cylinder banks 1L and 1R arranged in a V-formation with a predetermined relative angle. A row of three cylinders (not shown) are formed in the left cylinder bank 1L. Similarly, a row of three cylinders (not shown) are formed in the right cylinder bank 1R. The engine 1 has an air intake system 2 comprising a common intake pipe 4, a surge tank 3 and left and right discreet intake pipes 11L and 11R branching off from the surge tank 3. The cylinders in the left cylinder bank 1L are separately communicated with the surge tank 3 by way of the left discreet intake pipes 11L. Similarly, the cylinders in the right cylinder bank 1L are separately communicated with the surge tank 3 by way of the right discreet intake pipes 11R. The discreet intake pipes 11L and 11R are respectively provided with fuel injection valves 12L and 12R.

Common intake pipe 2 is provided with an air cleaner 5, an air flow sensor 6 and a throttle valve 7 as an engine load regulation valve arranged in this order from the upstream end toward the downstream end and has a bypass pipe 8 which allows intake air introduced into and flowing through the common intake pipe 2 to bypass the throttle valve 7. A continuously variable type of idle speed control (ISC) valve 9 is installed in the bypass pipe 7 to regulate the engine speed of rotation during running idle.

Engine 1 also has an exhaust system 21 comprising left and right exhaust pipes 22L and 22R. The left exhaust pipe 22L at its upstream end branches off into left discreet exhaust pipes 20L by way of which the cylinders in the left and right cylinder bank 1L are separately communicated with the left exhaust pipes 22L. Similarly, the right exhaust pipe 22R at its upstream end branches off into right discreet exhaust pipes 20R by way of which the cylinders in the right cylinder bank 1R are separately communicated with the right exhaust pipes 22R. These left and right exhaust pipes 22L and 22R at their downstream ends merge with a common exhaust pipe 23. The common exhaust pipe 23 is provided with an upstream oxygen ($O_2$) sensor 24, a catalytic converter for purifying exhaust gases, for example a three-way catalytic converter 25, and a downstream oxygen ($O_2$) sensor 26 arranged in this order from the upstream end toward the downstream end. The left exhaust pipe 22L is provided with an oxygen ($O_2$) sensor 27L located downstream from the left discreet intake pipes 20L. Similarly, the right exhaust pipe 22R is provided with an oxygen ($O_2$) sensor 27R located downstream from the right discreet intake pipes 20R. A fuel tank 31 is communicated with the surge tank 3 by way of a purge system 32 to introduce fuel vapor into the surge tank 3 from the fuel tank 31. The purge system 32 comprises a canister 33, a fuel vent pipe 34 by way of which the fuel tank 31 is communicated with the canister 33, a purge pipe 35 by way of which the surge tank 3 is communicated with the canister 33 having an air vent pipe 33*a* opening into the atmosphere, and a purge valve 36 installed in the purge pipe 35.

As is well known in the art, each of the oxygen ($O_2$) sensors 24, 26, 27L and 27R provides output which is reversed in level according to changes in air-to-fuel ratio with respect to the stoichiometric air-fuel mixture. The oxygen ($O_2$) sensors 24 and 26 are used in combination to detect or diagnose functional deterioration of the exhaust gas purifying catalytic converter 25. In particular, determination of functional deterioration of the exhaust gas purifying catalytic converter 25 is made based on a result of a comparison made between the numbers of reversals in level of output (H1 and H2) from the oxygen ($O_2$) sensors 24 and 26 in a predetermined period of time during execution of air-to-fuel ratio feedback control in which an air-fuel mixture is controlled to bring the air-to-fuel ratio back to a proper level so as to maintain a stoichiometric air-fuel mixture. For example, the exhaust gas purifying catalytic converter 25 is decided to have functionally deteriorated if the ratio of the numbers of reversals (H1/H2) is higher than a reference ratio or to function normally if the ratio of the numbers of reversals is lower than the reference ratio. On the other hand, the left oxygen ($O_2$) sensor 27L is used in the air-to-fuel ratio feedback control to control fuel injection of the fuel injection valve 12L in each left discreet intake pipe 11L. Similarly, the right oxygen ($O_2$) sensor 27R is used in the air-to-fuel ratio feedback control to control fuel injection of each fuel injection valve 12R in each right discreet intake pipe 11R. Diagnosis of the exhaust gas purifying catalytic converter 25 is executed while the air-to-fuel ratio feedback control is executed based on output from the oxygen ($O_2$) sensor 24. Because the diagnosis of an exhaust gas purifying catalytic converter and the air-to-fuel ratio feedback control are well known in the automobile art and have no direct relation to the invention, their construction and operation will not be set out in more detail.

During running idle, the speed of rotation of the engine 1 is controlled by learning and feedback control to reach a target idle speed of rotation through feedback control of the idle speed control valve 9. During air-to-fuel ratio feedback control and also during running idle, fuel vapor purge control is performed to control the purge valve 36 in such a way as to introduce fresh air into the canister 33 through the air vent pipe 33*a* and draw it through charcoal in the canister 33. As the air passes the charcoal in the canister 33, it picks up the stored fuel vapors and draw them into the surge tank 3 forming part of the are intake system 2 where they are mixed with fuel for burning. When performing the on-idle fuel vapor purge, the idle speed control valve 9 is reduced in opening so as to subtract the quantity of purge gas from the quantity of air bypassing therethrough.

Figure 2:
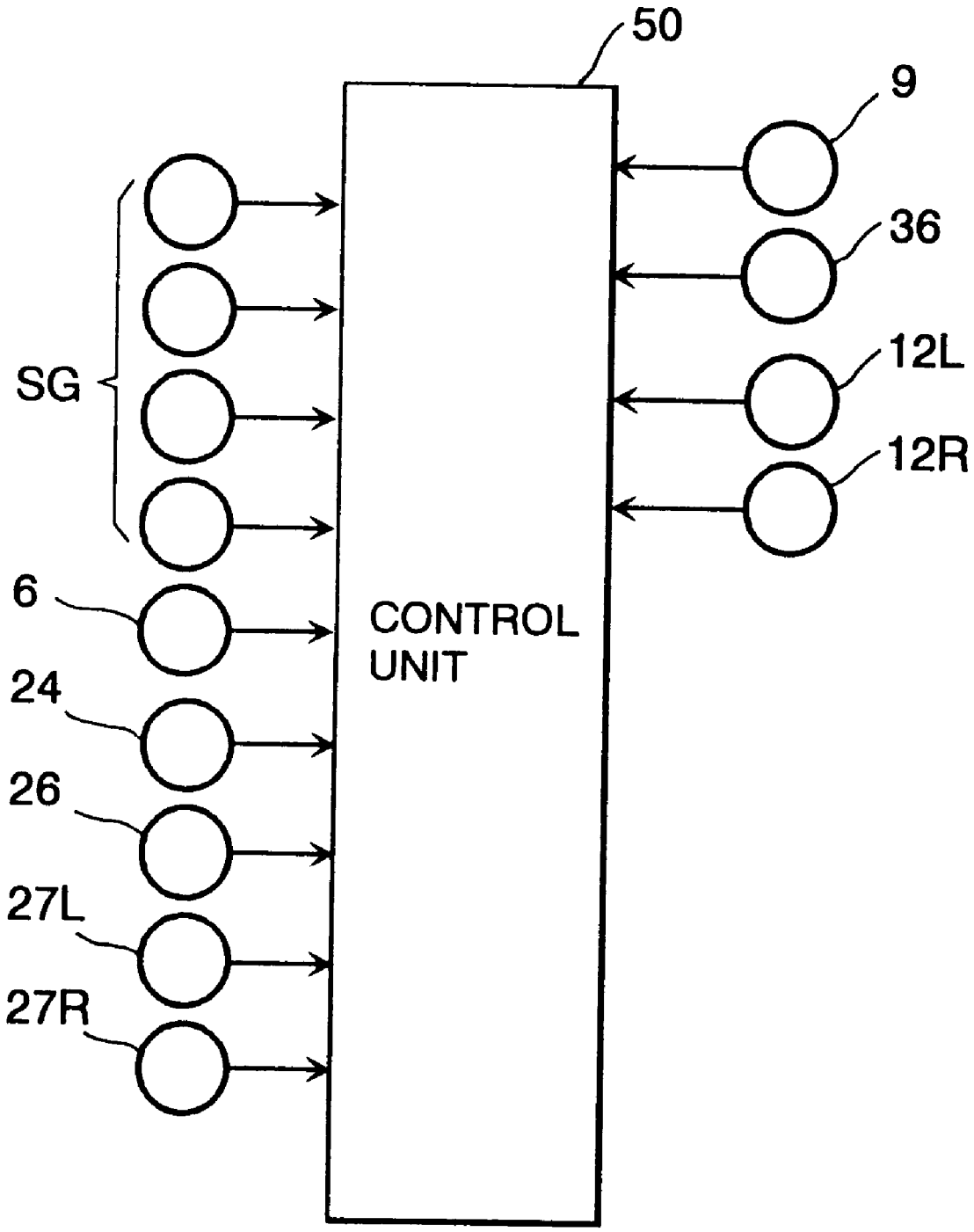
FIG. 2 is a block diagram showing a fuel control system according to an embodiment of the invention.

FIG. 2 is a block diagram schematically showing a control system for the air-to-fuel ratio control and the fuel vapor purge control. The fuel control system includes a control unit 50 comprising, for example, a microcomputer. The control unit 50 receives signals from various sensors, including the air flow sensor 6, the oxygen ($O_2$) sensors 24, 26, 27L and 27R, sensors S1–S3 for detecting an engine speed of rotation, the temperature of engine cooling water and atmospheric pressure, respectively, and sensors inclusively labeled SG for providing signals indicative of various data necessary to perform various controls. All these sensors are well known in various forms in the automobile art and may take any known forms. The control unit 50 provides control signals for the idle speed control valve 9, the purge valve 36, and the fuel injection valves 12L and 12R.

Figure 3:
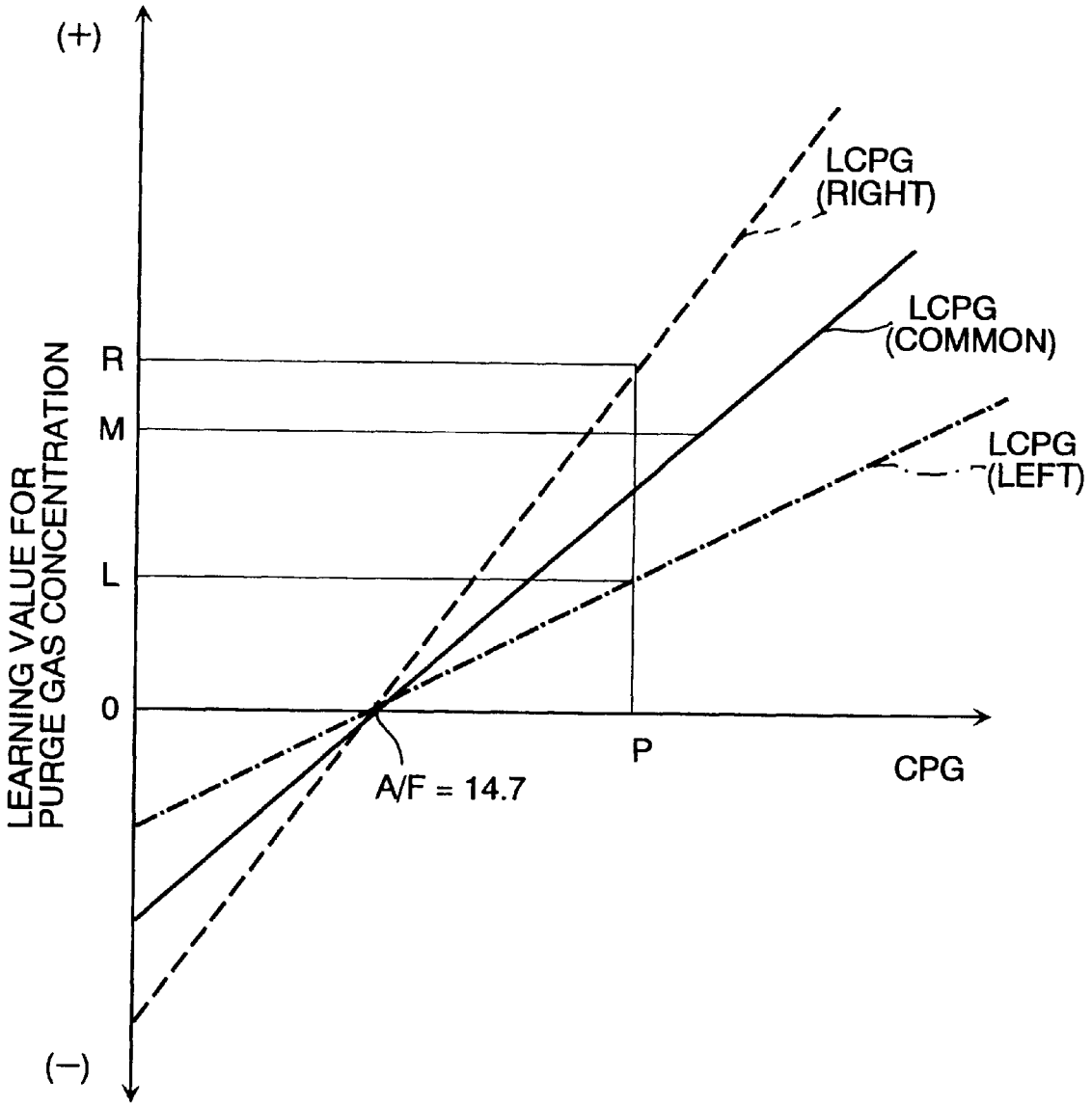
FIG. 3 is a time chart of control by the fuel control system.

Control unit 50 performs the air-to-fuel ratio control during fuel vapor purge. Specifically, as shown in FIG. 3, when determination of functional deterioration of the exhaust gas purifying catalytic converter 25 is not executed, the utilization is made of the oxygen ($O_2$) sensors 27L and 27R to perform the air-to-fuel ratio feedback control independently for the fuel injection valves 12L and 12R, respectively, (which is hereafter referred to as independent air-to-fuel ratio feedback control). The fuel injection valve 12L for each cylinder in the left cylinder bank 1L is controlled to deliver fuel of the amount changed by a decrement of the content of fuel of a purge gas introduced into the left discreet intake pipe 11L. Similarly, the fuel injection valve 12R for each cylinder in the right cylinder bank 1R is controlled to deliver fuel of the amount changed by a decrement of the content of fuel of a purge gas introduced into the right discreet intake pipe 11R. The concentration of fuel of a purge gas introduced into each discreet intake pipe 11L, 11R (which is hereafter referred to as the purge gas concentration CPG) is estimated based on an air-to-fuel ratio feedback control value CFB. Practically, a value for learning the purge gas concentration (which is referred to as a concentration learning value LCPG) is estimated based on a tempered value of the air-to-fuel ratio feedback control value CFB and stored. In FIG. 3, a dotted broken line depicts the concentration learning value LCPG for a purge gas introduced into the cylinders in the left cylinder bank 1L, and a broken line depicts the concentration learning value LCPG for a purge gas introduced into the cylinders in the right cylinder bank 1R.

Upon satisfaction of the prescribed condition for execution of the determination of functional deterioration of the exhaust gas purifying catalytic converter 25 during the independent air-to-fuel ratio control, all of the fuel injection valves 12L and 12R are commonly controlled by the air-to-fuel ratio feedback control based on output from the oxygen ($O_2$) sensors 24 (which is hereafter referred to as the integrated air-to-fuel ratio control). During the integrated air-to-fuel ratio control as well as during the independent air-to-fuel ratio feedback control, the concentration learning value LCPG is estimated based on a tempered value of the air-to-fuel ratio feedback control value CFB and stored. A solid line depicts the concentration learning value LCPG in FIG. 3. In the independent air-to-fuel ratio feedback control, the ratio between concentration learning values LCPGs for purge gases introduced into the cylinders in the left and right cylinder banks 1L and 1R is represented by LCPG(L)/LCPG (R) for a specific purge gas concentration CPG(P).

On the other hand, in the integrated air-to-fuel ratio control, when the concentration learning value is given by LCPG(M) for the specific purge gas concentration CPG(P), the concentration learning value LCPG(M) is divided according to the ratio of concentration learning values LCPG(L)/LCPG(R) and assigned the cylinders in the left and right cylinder banks 1L and 1R. That is, the cylinders in the left cylinder bank 1L are assigned a concentration learning value of 2•LCPG(M)•LCPG(L)/[(LCPG(L)+LCPG (R)]. Similarly, the cylinders in the right cylinder bank 1R is assigned the concentration learning value of 2•LCPG(M)•LCPG(R)/[(LCPG(L)+LCPG(R)]. The amount of fuel delivered from the individual fuel injection valve 12L, 12R is changed from the basic amount of fuel by a decrement corresponding to the concentration learning value of 2•LCPG(M)•LCPG(L)/[(LCPG(L)+LCPG(R)] or 2•LCPG(M)•LCPG(R)/[(LCPG(L)+LCPG(R)].

Operation of the fuel control system depicted in FIGS. 1 and 2 is best understood by reviewing FIGS. 4 through 7 which are flow charts illustrating sequence routines of the fuel vapor purge control and the air-to-fuel ratio control for a microcomputer as the control unit 50.

Figure 4:
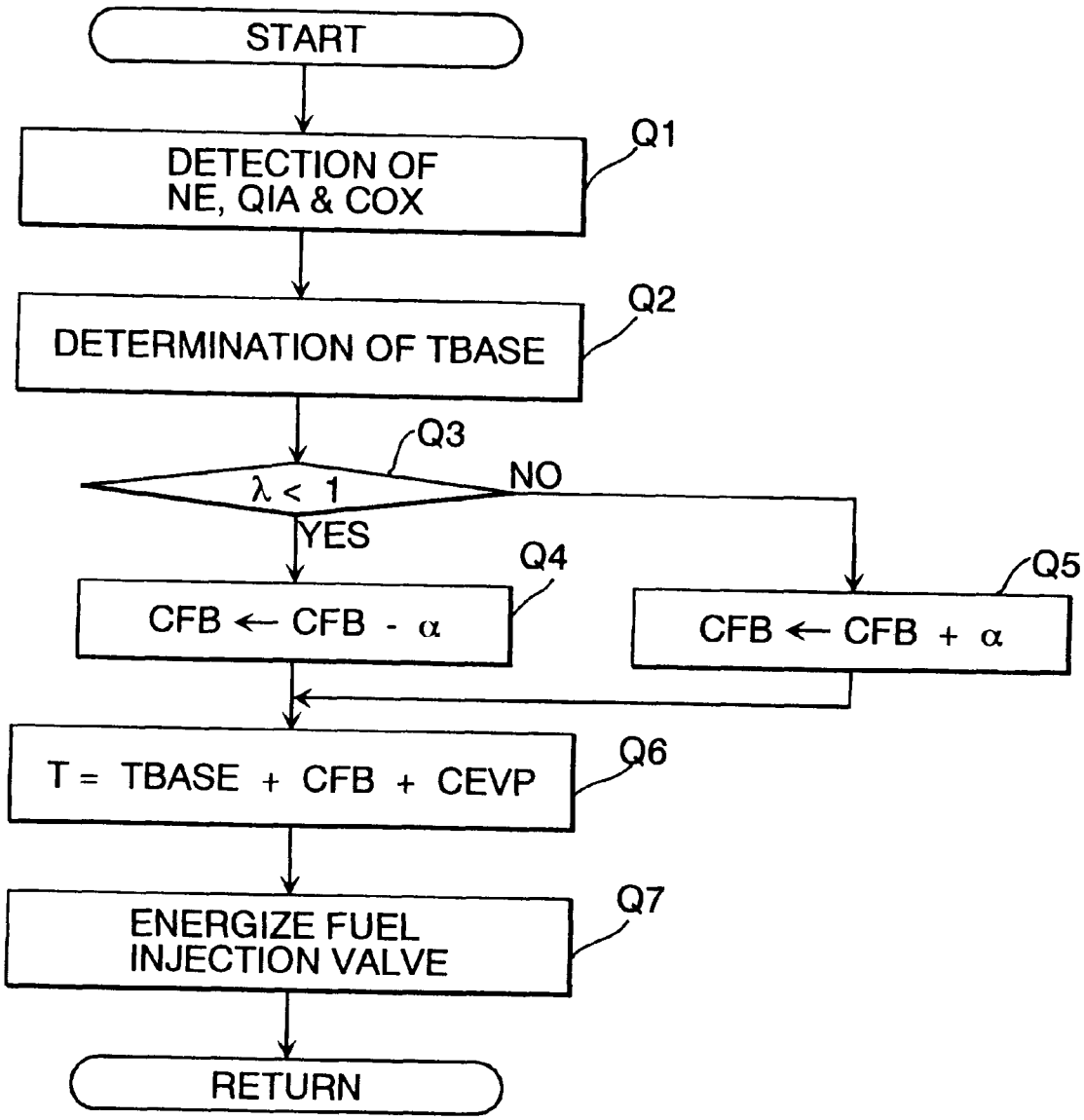
FIG. 4 is a flow chart illustrating an air-to-fuel ratio control sequence routine.

Referring to FIG. 4, which is a flow chart illustrating the air-to-fuel ratio feedback control sequence routine in which the utilization is made of an air-to-fuel ratio feedback control value CFB to control an air-to-fuel ratio, when the flow chart logic commences and control proceeds directly to a function block at step Q1 where an engine operating condition, including such as an engine speed of rotation NE, the amount of intake air QIA, the concentration of oxygen COX in an exhaust gas, are detected based on signals from the sensors. A basic amount of fuel TBASE to be delivered from the individual fuel injection valve 12L, 12R is determined by looking up a map of fuel injection amount with respect to the engine speed of rotation NE and the amount of intake air QIA at step Q2. Subsequently, a determination is made at step Q3 as to whether the excess air ratio $\lambda$ is less than 1 (one). If the excess air ratio $\lambda$ is less than 1 (one), this indicates that the air-fuel ratio delivers an air-fuel mixture enriched more than a stoichiometric air-fuel mixture, then, the latest air-to-fuel ratio feedback control value CFB is established by changing the previous air-to-fuel ratio feedback control value CFB by a decrement of a specific value $\alpha$ ($\alpha$>0) at step Q4. On the other hand, if the excess air ratio $\lambda$ is equal to or greater than 1 (one), this indicates that the air-fuel ratio delivers an air-fuel mixture made learner than the stoichiometric air-fuel mixture, then, the latest air-to-fuel ratio feedback control value CFB is established by changing the previous air-to-fuel ratio feedback control value CFB by an increment of the specific value $\alpha$ at step Q5. After establishing the latest air-to-fuel ratio feedback control value CFB at step Q4 or Q5, an eventual amount of fuel T to be delivered by the individual fuel injection valve 12L, 12R is computed by adding the basic amount of fuel TBASE, the air-to-fuel ratio feedback control value CFB and the amount of fuel purged into the cylinder bank 1L, 1R (which is referred to as the amount of purged fuel CEVP) all together at step Q6. The amount of purged fuel CEVP is delivered to the cylinders in the respective cylinder bank 1L, 1R as described later. Finally, the fuel control system energizes and keeps the individual fuel injection valve 12L, 12R open sufficiently long to deliver the eventual amount of fuel T therethrough at step Q7.

Figure 5:
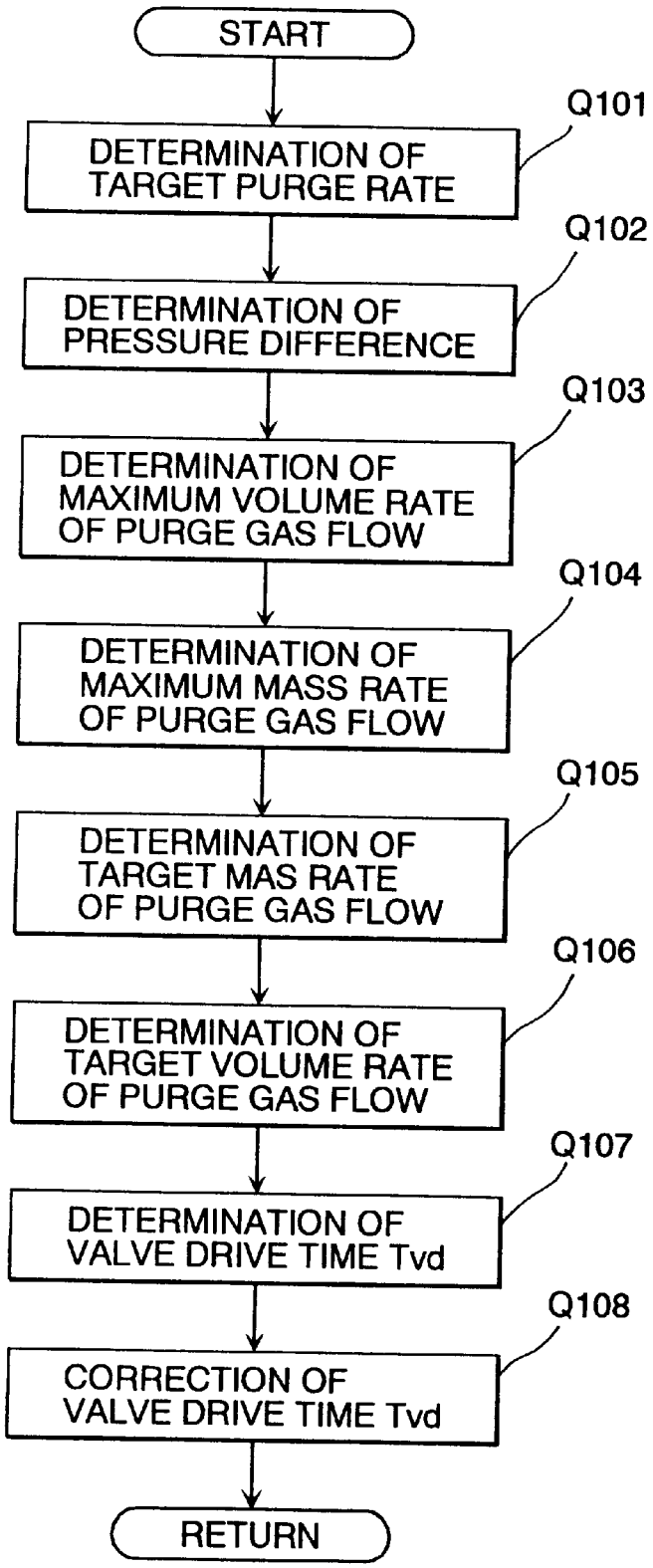
FIG. 5 is a flow chart illustrating a fuel vapor purge control sequence routine.

FIG. 5 is a flow chart of the sequence routine of vapor purge control for controlling the purge valve 36 in operation to regulate the amount of fuel vapors to be purged into the engine 1. When the flow chart logic commences and control proceeds directly to a function block at Q101 where a target purge rate TPR is determined. This target purge rate TPR is defined as a mass rate of purge gas flow (%) relating to the mass rate of intake air flow measured by the air-flow sensor 6, and it has an initial set of 0 (zero). In this instance, purge gas is regarded as atmosphere. The target purge rate TPR is increasingly or decreasingly changed according to the air-to-fuel ratio feedback control value CFB, which is a deviation of an air-to-fuel ratio A/F from an ideally combustible air-to-fuel ratio for a stoichiometric air-fuel mixture in the air-to-fuel ratio feedback control. In this instance, the target purge rate TPR is established so as to purge as a large amount of fuel vapors as possible as will be described in detail later.

Subsequently, an estimate is made in relation to a difference DPR between pressure before and after the purge valve 36 at step Q102. Specifically, the pressure difference DPR is defined as a difference of intake air pressure from atmospheric pressure. In this instance, the intake air pressure is estimated by looking up a map of intake air pressure with parameters regarding an engine operating condition such as an engine speed of rotation and a mass rate of intake air flow measured by the air flow sensor 6 and corrected according to the temperature of intake air. After the estimate of the pressure difference of intake air DPR, a maximum volume rate of purge gas flow VRmax ($cm^3$/min), which depends upon the pressure difference of intake air for a full opening of the purge valve 36, is determined as an upper limit amount of purge gas at step Q103 and transformed into a maximum mass rate of purge gas flow MRmax (kg/s) at step Q104. A target mass rate of purge gas flow TMR (kg/s) is determined based on the target purge rate TPR and the mass rate of intake air flow so as to be less than the maximum mass rate of purge gas flow MRmax (kg/s) at step Q105, and is subsequently transformed into a target volume rate of purge gas flow TVR ($cm^3$/min) at step Q106.

At step Q107, a valve drive time, i.e. a duty ratio Tvd (a ratio of open time relating to one cycle of time), of the purge valve 36 is determined taking the pressure difference DPR determined at step Q102 into consideration. The duty ratio Tvd is corrected as an effective duty ratio according to the voltage of a battery and an ineffective time at the beginning of valve operation at step Q108.

Figure 6:
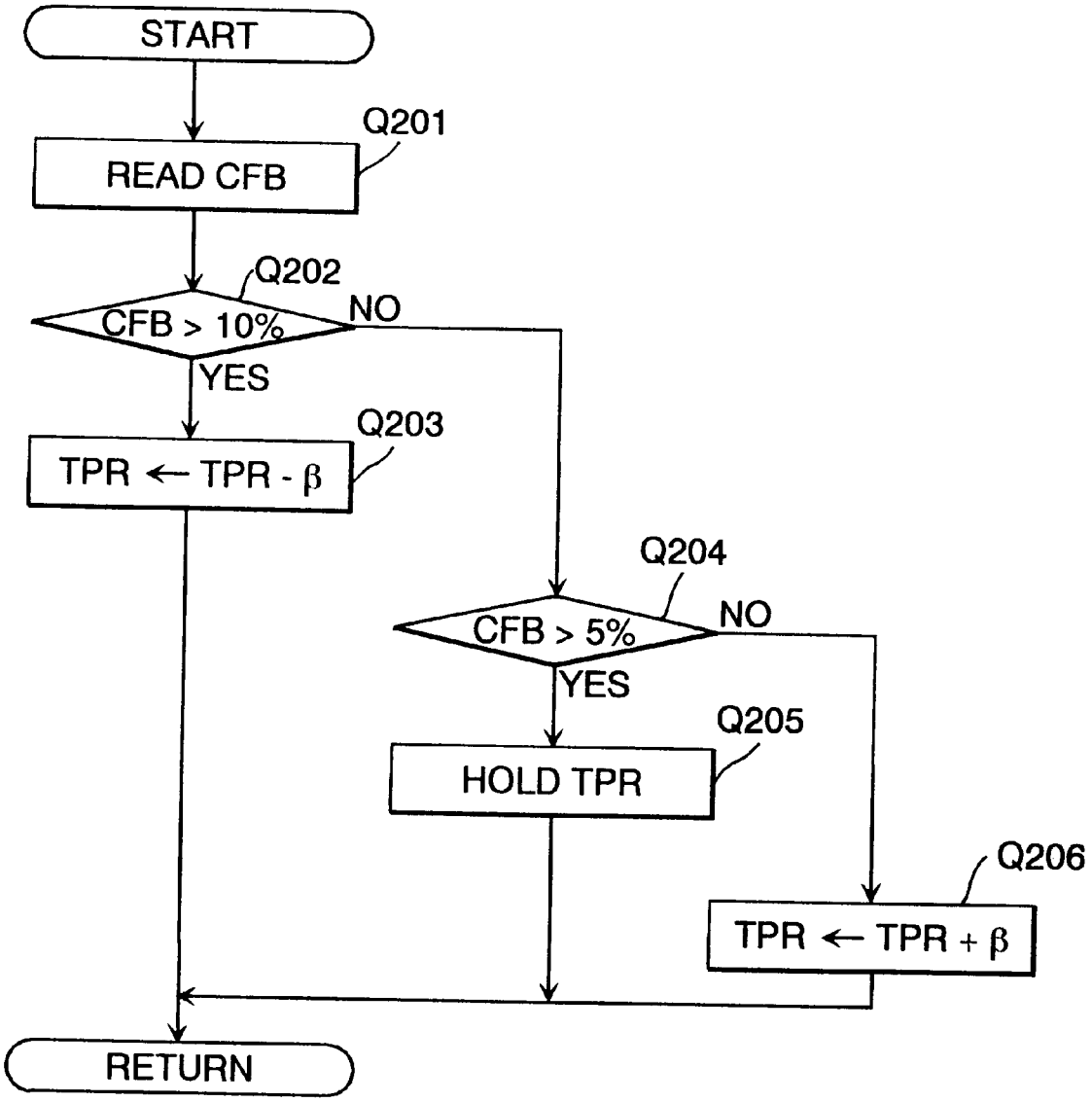
FIG. 6 is a flow chart illustrating a sequence routine of target fuel vapor purge rate determination.

FIG. 6 is a flow chart illustrating a subroutine of determining the target purge rate TPR at step Q101 in the vapor purge control sequence routine shown in FIG. 5. In the target purge rate determination subroutine, in order to purge as a large amount of fuel vapors as possible, the target purge rate TPR is established as large as possible within a range where it makes the air-to-fuel ratio feedback control value CFB remain off a side on which an air-fuel mixture is significantly enriched.

Specifically, after reading the air-to-fuel ratio feedback control value CFB at step Q201, a determination is made at step Q202 as to whether the air-to-fuel ratio feedback control value CFB is greater than a first threshold level of 10%. When the air-to-fuel ratio feedback control value CFB is greater than the first threshold level of 10%, then, the target purge rate TPR is changed by a decrement of a specified value $\beta$ at step Q203. On the other hand, when the air-to-fuel ratio feedback control value CFB is equal to or less than the first threshold level of 10%, another determination is made at step Q204 as to whether the air-to-fuel ratio feedback control value CFB is greater than a second threshold level of 5%. When the air-to-fuel ratio feedback control value CFB is greater than the second threshold level of 5%, the target purge rate TPR is held unchanged at step Q205. On the other hand, when the air-to-fuel ratio feedback control value CFB is equal to or less than the second threshold level of 5%, then, the target purge rate TPR is changed by an increment of the specified value $\beta$ at step Q206.

By this way, the target purge rate TPR is decreased in steps whenever the air-to-fuel ratio feedback control value CFB is greater than the first threshold level of 10%, held unchanged whenever the air-to-fuel ratio feedback control value CFB is between the first and second threshold levels of 5 and 10%, and increased in steps whenever the air-to-fuel ratio feedback control value CFB is less than the second threshold level 5%. When determining the target purge rate TPR, it may be done to employ a tempered air-to-fuel ratio feedback control value CFB.

Figure 7:
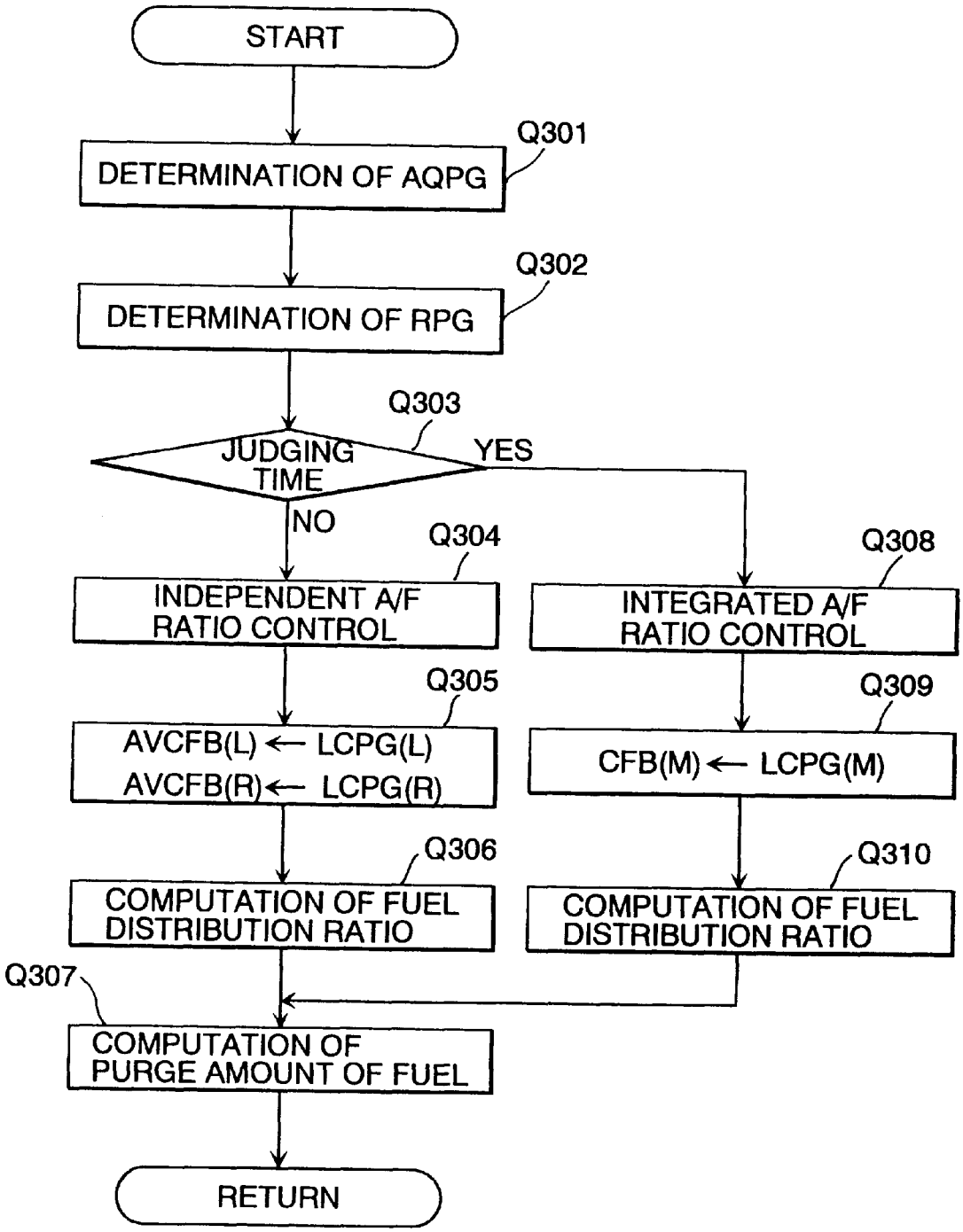
FIG. 7 is a flow chart illustrating a sequence routine of computation of a fuel vapor purge control value.

FIG. 7 is a flow chart illustrating a sequence subroutine of determining a fuel vapor purge control value. When the flow chart logic commences and control proceeds directly to a function block at Q301 where the actual amount of purge gas AQPG is determined based on the target mass rate of purge gas flow TMR (which is determined at step Q105 in FIG. 5) in consideration of a time lag in fuel vapor purge from a point of time at which fuel vapors are drawn from the canister 33 to a point of time at which the fuel vapors reach the surge tank 3 through the purge pipe 35. At step Q302, a ratio (%) of the content of fuel of the purge gas relative to the total amount of air introduced into the surge tank 3 (a purge gas ratio RPG) is determined based on the actual amount of purge gas AQPG and the amount of intake air detected by the air flow sensor 6. Subsequently, a determination is made at step Q303 as to whether it is time to determine functional deterioration of the exhaust gas purifying catalytic converter 25. When it is not yet time to determine functional deterioration of the exhaust gas purifying catalytic converter 25, this indicates execution of the independent air-to-fuel ratio feedback control, then, the independent air-to-fuel ratio feedback control is executed at step Q304.

Subsequently, at step Q305, a deviation of an actual air-to-fuel ratio A/F(A) from a target air-to-fuel ratio A/F(T), which is defined as an average of air-to-fuel ratio feedback control values CFBs at adjacent points of time of reversal thereof between an upward tendency and a downward tendency, is computed and stored as a concentration learning value LCPG after necessary correction. In this instance, as described in detail later in connection with FIG. 10, the concentration learning value LCPG is changed by a decrement corresponding to a learning gain G ($0<G<1$) in steps when the deviation of the actual air-to-fuel ratio A/F(A) is less than an upper threshold level of 2% in such a direction as to enrich an air-fuel mixture or by an increment corresponding to the learning gain G in steps when the deviation of the actual air-to-fuel ratio A/F(A) is greater than a lower threshold level of 2% in such a direction as to rarefy an air-fuel mixture. The concentration learning value LCPG is initially set to 0 (zero) when the vehicle is shipped and retained even when an ignition switch is turned off. In cases where the purge gas flow rate is less than a specified level such as, for example, 3000 $cm^3$/min, where the temperature of engine cooling water is lower than a specified temperature such as, for example, 80° C., where the engine is under transitional operating conditions, i.e. out of a steady operating condition, and/or where the engine is at a stage immediately after starting, the concentration learning value LCPG is not renewed nor replaced with a latest one.

Subsequently to the determination of the concentration learning values LCPG(L) and LCPG(R) for the fuel injection valves 12L and 12R for the cylinders in the left and right cylinder banks 1L and 1R, respectively, at step Q305, a distribution ratio of fuel of the purge gas between the cylinders in the respective cylinder banks 1L and 1R is computed from the latest concentration learning values LCPG(L) and LCPG(R) at step Q306, and finally, proportions of fuel of the purge gas to be distributed and delivered to the cylinders in the respective cylinder bank 1L, 1R are determined based on the ratio of concentration learning values of LCPG(L):LCPG(R) and the purge gas ratio RPG at step Q307. As was previously described, this proportion of fuel distribution is used as the amount of purged fuel CEVP by which the amount of fuel delivered by the fuel injection valves 12L, 12R is reduced. The eventual amount of fuel delivered by the fuel injection valve is basically determined according to an engine speed of rotation and an engine load, and is corrected according to various factors including an air-to-fuel ratio feedback control value CFB, a voltage of a battery, the temperature of intake air and atmospheric pressure. The concentration learning value LCPG(L), LCPG(R) is of coerce used as a reduction factor to reduce the amount of fuel to be delivered by the fuel injection valves 12L, 12R as well as the air-to-fuel ratio feedback control values CFBs.

When it is time to determine functional deterioration of the exhaust gas purifying catalytic converter 25, the integrated air-to-fuel ratio feedback control is executed at step Q308. Subsequently, a concentration learning value LCPG for another execution of the integrated air-to-fuel ratio feedback control is determined based on the air-to-fuel ratio feedback control value CFB at step Q309, and a distribution ratio of fuel of the purge gas for the cylinders in the respective cylinder banks 1L and 1R is computed at step Q310. The fuel distribution ratio between the cylinders in the left cylinder bank 1L and the cylinders in the right cylinder bank 1R is given by 2•LCPG(M)•LCPG(L)/[(LCPG(L)+LCPG(R)]:2•LCPG(M)•LCPG(R)/[(LCPG(L)+LCPG(R)]. Proportions of fuel of the purge gas to be distributed and delivered to the cylinders in the respective cylinder bank 1L, 1R are determined based on the distribution ratio of 2•LCPG(M)•LCPG(L)/[(LCPG(L)+LCPG(R)]:2•LCPG(M)•LCPG(R)/[(LCPG(L)+LCPG(R)] and the purge gas ratio RPG at step Q307.

Figure 8:
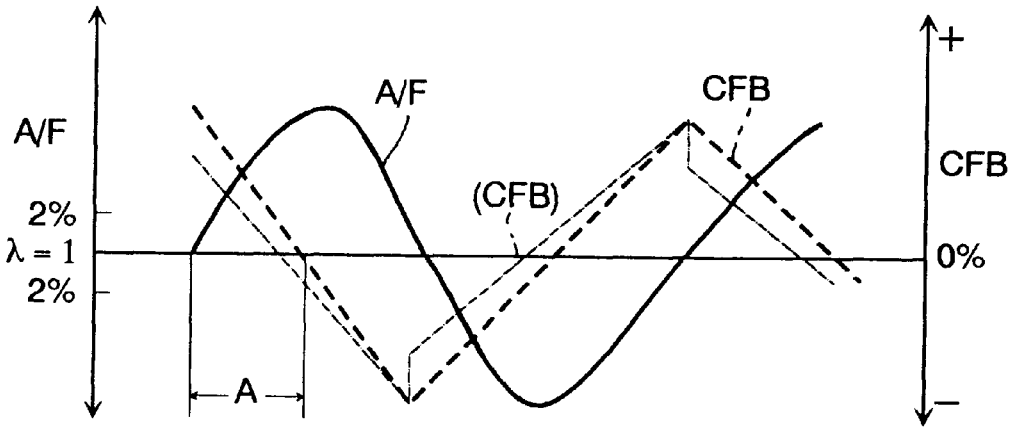
FIG. 8 is a diagram showing a time-difference in phase between an actual air-to-fuel ratio and an air-to-fuel ratio feedback control value.
Figure 10:
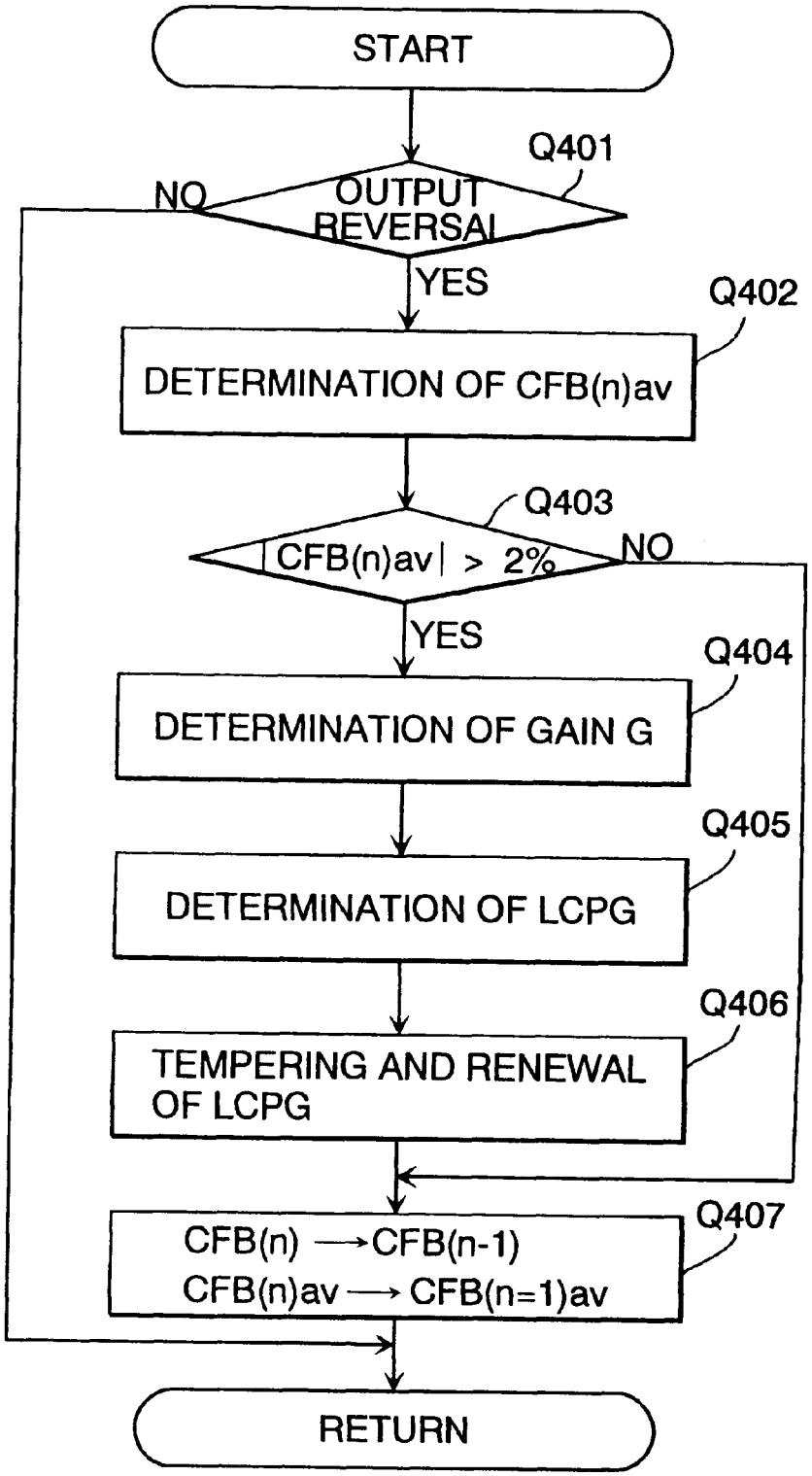
FIG. 10 is a flow chart illustrating a sequence routine of concentration learning value correction.

Concentration learning value LCPG is determined following the flow chart logic shown in FIG. 10. As shown in FIG. 8, there is a relationship between an actual air-to-fuel ratio A/F(A) and an air-to-fuel ratio feedback control value CFB which has a time-difference in phase of approximately $\pi/2$. Due to the time-difference in phase, for the period of time A in FIG. 8, the air-to-fuel ratio A/F eventually delivered is on the side enriching an air-fuel mixture more than a stoichiometric air-fuel mixture, and consequently, the air-to-fuel ratio feedback control value CFB changes in such a direction as to provide a leaner air-fuel mixture. However, the absolute value of the air-to-fuel ratio feedback control value CFB indicates that the actual air-to-fuel ratio A/F(A) is off to the side providing a leaner air-fuel mixture. That is, in that period of time A, while the air-to-fuel ratio feedback control value CFB indicates that the actual air-to-fuel ratio A/F(A) is on the side providing an air-fuel mixture enriched more than the stoichiometric air-fuel mixture, nevertheless, it pretends to be at a plus level above 0% and demands fuel more than a level of the excess air ratio $\lambda$ of 1 (one). As a result, it is determined that the air-fuel mixture is lean. At this time, while, because the air-to-fuel ratio A/F provides an air-fuel mixture enriched more than the stoichiometric air-fuel mixture, fuel vapors stored in the canister 33 is regarded to be increasing, the air-to-fuel ratio feedback control value CFB takes a level greater than the upper threshold level 2% in that period of time A, forcing the concentration learning value LCPG to change in such a direction as to decrease. As a result, the concentration learning value LCPG is increased in an opposite direction. On the other hand, because, though the air-to-fuel ratio A/F is on a side delivering an enriched air-fuel mixture due to the fact that the air-to-fuel ratio feedback control value CFB is decreasing in that period of time A, it encounters a great deviation resulting from a great decrease in the amount of fuel delivered by the fuel injection valve 12L, 12R and a great decrease in the concentration learning value LCPG, it causes hunting.

Figure 9:
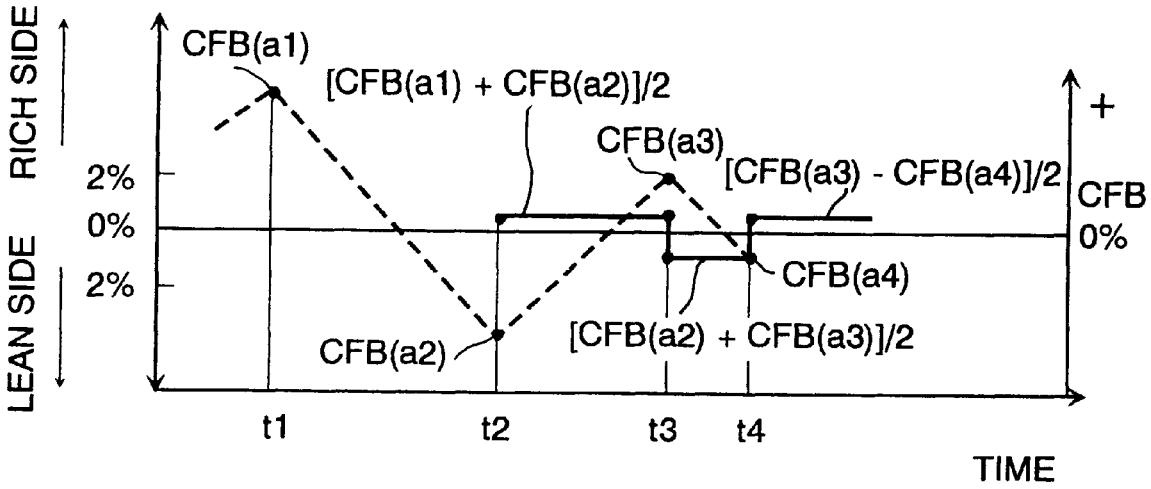
FIG. 9 is an explanatory time chart showing determination of a deviation of an air-to-fuel ratio from a target air-to-fuel ratio based on the air-to-fuel ratio feedback control value upon reversals.

In the fuel control system, the concentration learning value LCPG is determined depending not directly on the air-to-fuel ratio feedback control value CFB used as the deviation of the actual air-to-fuel ratio A/F(A) from the target air-to-fuel ratio A/F(T) but on a value relating to a change in the air-to-fuel ratio feedback control value CFB before a point of time of reversal from a downward tendency to an upward tendency or vice versa. In more details, as shown in FIG. 9, the air-to-fuel ratio feedback control value CFB is reversed intermittently between a downward tendency and an upward tendency at times, for example, t1, t2, t3 and t4. The reversal of the air-to-fuel ratio feedback control value CFB occurs at the same time as reversal of output of the oxygen ($O_2$) sensor. For example, when the latest reversal of the air-to-fuel ratio feedback control value CFB occurs at the time t2, the immediately previous reversal of the air-to-fuel ratio feedback control value CFB has occurred at the time t1. An average of the air-to-fuel ratio feedback control values CFBav=CFB(t1) and CFB(t2) at the times t1 and t2 is employed as a deviation of the actual air-to-fuel ratio A/F(A) from the target air-to-fuel ratio A/F(T). When the average air-to-fuel ratio feedback control value CFBav=[CFB(t1)+CFB(t2)]/2 is greater than the upper threshold level of 2% in such a direction as to provide an increase in the amount of fuel, in other words, when the deviation is greater than the upper threshold level of 2%, i.e. when the air-to-fuel ratio feedback control value CFB used to learn the concentration of fuel of a purge gas continuously increases across a level of 0% and exceeds the upper threshold level of 2%, the air-to-fuel ratio feedback control value CFB is changed in steps by a decrement of the learning gain G. On the other hand, when the deviation is smaller than the lower threshold level of 2%, the air-to-fuel ratio feedback control value CFB is conversely changed in steps by an increment of the learning gain G. By this way, corrections on fuel vapor purge by means of an actual air-to-fuel ratio and a concentration learning value occur in unison on direction, establishing a precise amount of fuel to be delivered so as to perform precise control of an air-to-fuel ratio.

Though the deviation of an actual air-to-fuel ratio from a target air-to-fuel ratio is given by an average of air-to-fuel ratio feedback control values CFBs at adjacent two points of time of reversal in the preceding embodiment, it may be given by an average of more than two air-to-fuel ratio feedback control values CFBavs at points of time including the adjacent two points of time of reversal, or otherwise by a value relating to a change thereof before a point of time of reversal. While the deviation is inferior in responsiveness due to that it is determined by use of a plurality of air-to-fuel ratio feedback control values CFBs, because the concentration learning value does not change sharply, the responsiveness of the deviation itself does not matter.

FIG. 10 is a flow chart illustrating the sequence subroutine of correctively determining a concentration learning value (a value for learning the concentration of fuel of a purge gas) LCPG executed at step Q305 in the fuel vapor purge control value determination subroutine shown in FIG. 7. When the flow chart logic commences and control passes directly to a determination regarding reversal of output of the oxygen ($O_2$) sensor at a point of time (t1, t2, . . . ) at step Q401. When reversal of output of the oxygen ($O_2$) sensor, an average of air-to-fuel ratio feedback control values CFB(n) and CFB (n−1) at adjacent two points of time of reversal, namely the latest reversal and the immediately previous reversal, is computed as a deviation of an actual air-to-fuel ratio from a target air-to-fuel ratio at step Q402. A determination is subsequently made at step Q403 as to whether the absolute value of the average air-to-fuel ratio feedback control value CFB(n)av is greater than a threshold level of 2%. When the absolute average air-to-fuel ratio feedback control value CFBav is greater than the threshold level of 2%, the learning gain G is determined based on the average air-to-fuel ratio feedback control value CFB(n)av at step Q404. In this instance, the learning gain G is made to be larger when the average air-to-fuel ratio feedback control value CFB(n)av is large than when it is small. The learning gain G may be changed in, for example, three steps according to average air-to-fuel ratio feedback control values CFBavs, or otherwise may be changed linearly or nonlinearly according to average air-to-fuel ratio feedback control values CFBavs. In other words, the learning gain G is established in such a way as to increase a change rate at which the concentration learning value LCPG is changed according to average air-to-fuel ratio feedback control values CFBavs.

Figure 11:
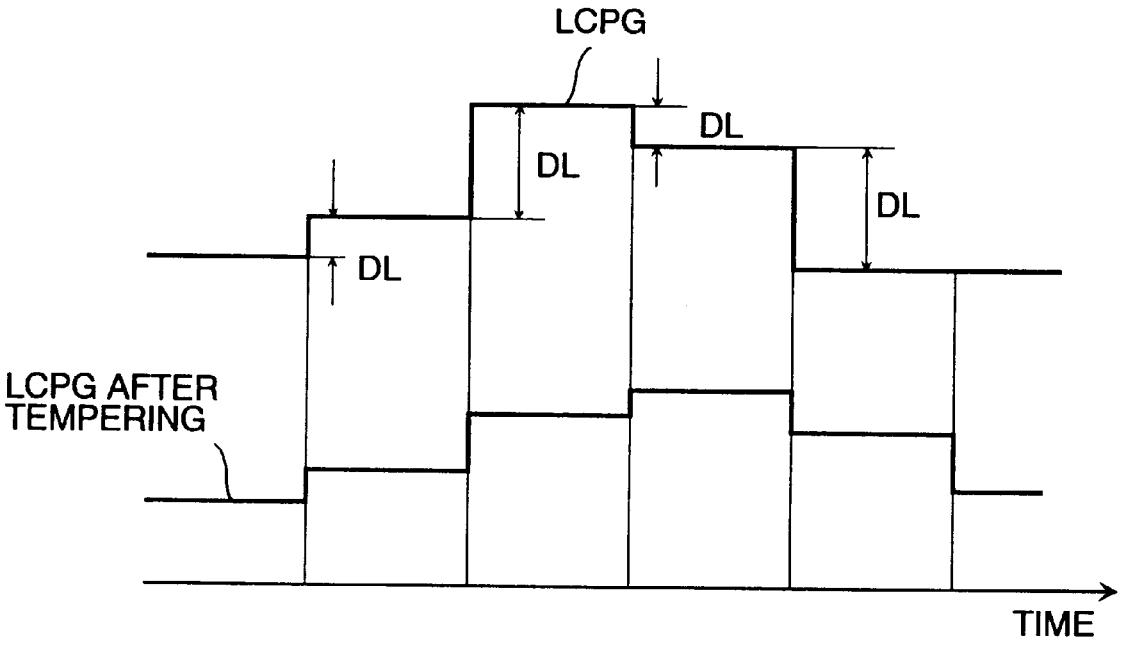
FIG. 11 is a diagram showing the concentration learning value before and after tempering.

Thereafter, at step Q405, the concentration learning value LCPG is tempered and determined by being changed by an increment or a decrement of the learning gain G. As seen in FIG. 11, the change rate, which is depicted by a level difference DL between adjacent two concentration learning values LCPGs, increases correspondingly to an increase in the learning gain G. Subsequently, at step Q406, the concentration learning value LCPG is tempered and renewed by modifying the latest and immediately previous concentration learning values LCPG(n) and LCPG(n−1) as follows:

$$LCPG=G\cdot LCPG(n)+(1-G)\cdot LCPG(n-1)$$

The tempered concentration learning value LCPG, which is shown in FIG. 11, is practically used as an estimated concentration of fuel of a purge gas. At step Q407, the latest air-to-fuel ratio feedback control value CFB(n) and the latest average air-to-fuel ratio feedback control value CFB(n)av are replaced as an updated previous air-to-fuel ratio feedback control value CFB(n−1) and an updated previous average air-to-fuel ratio feedback control value CFB(n−1)av, respectively.

When no reversal of output of the oxygen ($O_2$) sensor is monitored, the flow chart logic directly returns for another execution. On the other hand, when the absolute average air-to-fuel ratio feedback control value CFB(n)av is equal to or less than the threshold level of 2%, the flow chart logic passes directly to step Q407 to replace the latest air-to-fuel ratio feedback control value CFB(n) and the latest average air-to-fuel ratio feedback control value CFB(n)av as updated previous ones, respectively.

Although the condition for execution of fuel vapor purge may be suitably prescribed, it is desirable to satisfy all of the following requirements on condition that the engine system normally operates:

(A) the temperature of engine cooling water is higher than a specified level or the amount of fuel is not increased to warm up the engine;

(B) the temperature of air is higher than a specified level or the value for learning the concentration of fuel of a purge gas is greater than a specified level, which is regarded that the amount of fuel of a purge gas is estimated to be large;

(C) the rate of purge gas flow is lower than the amount of intake air meeting a demand of the engine; and (D) the content of fuel of a purge gas is less than the amount of fuel meeting a demand of the engine.

Upon updating concentration learning value, the air-to-fuel ratio feedback control value may be changed in one step by an increment or a decrement corresponding to a difference between concentration learning values before and after updating. That is, when the concentration learning value is updated with the result of a decrease, while the deviation of an air-to-fuel ratio from a target air-to-fuel ratio is eliminated or significantly decreased by increasing the air-to-fuel ratio feedback control value in one step in such a direction as to increase the amount of fuel correspondingly to the decrease, the air-to-fuel ratio feedback control is performed with an improved follow-up characteristic.

When a specified number of times of reversal of the air-to-fuel ratio feedback control value CFB do not occur in a specified period of time after commencement of fuel vapor purge, it is regarded that there is a great difference between the actual content of fuel of a purge gas and the learned concentration of fuel of the purge gas, then, it is desirable to increase the learning gain G.

Deviation of an actual air-to-fuel ratio from a target air-to-fuel ratio which is provided to learn the concentration of fuel of a purge gas may be used as a control value for feedback controlling the air-to-fuel ratio. That is, while air-to-fuel ratio feedback control value itself may be obtained in a conventional manner, it may be modified as a parameter for eventually feedback controlling the amount of fuel to be delivered by the fuel injection valves.

In cases where the concentration learning value takes such an unusual level as to indicate that it is impossible that the engine system and its associated devices can be regarded normal in function, it is preferred to interrupt the fuel vapor purge, or otherwise to reduce the amount of purge gas.

Learning gain G may be changed according to engine operating conditions. For example, in a state of acceleration where the concentration of a purge gas shows fluctuations violent as compared with an ordinary state of operation, the concentration of a purge gas can be estimated more rapidly and precisely during acceleration by increasing the learning gain G. Estimation of the concentration of a purge gas is made with the same effect resulting from increasing the learning gain G during a change in opening of the purge valve larger than during remaining the purge valve unchanged in opening. The air-to-fuel ratio feedback control value may be changed abruptly at every reversal thereof as indicated by a dotted line in FIG. 8.

It is to be understood that the present invention may be embodied with various changes, modifications and improvements, which may occur to those skilled in the art, without departing from the spirit and scope of the invention defined in the following claims.

What is claimed is:

1. A fuel control system for an automobile engine for executing air-to-fuel ratio feedback control to feedback control the amount of fuel delivered to the engine based on an air-to-fuel ratio feedback control value so as to deliver a target air-to-fuel ratio, the air-to-fuel ratio feedback control value being decreased according to an air-to-fuel ratio deviation of an actual air-to-fuel ratio from the target air-to-fuel ratio when the actual air-to-fuel ratio is on a rich side and increased according to the air-to-fuel ratio deviation when the actual air-to-fuel ratio is on a lean side, the fuel control system comprising:

determination means for taking an absolute air-to-fuel ratio feedback control value smaller than an absolute value of said air-to-fuel ratio feedback control value at a point in close proximity to a reversal of an air-to-fuel ratio feedback control value between a downward tendency and a upward tendency for an attributive value relative to a ratio of fuel to air in an air intake system; and fuel control value determination means for determining a fuel control value for controlling the amount of fuel delivered to the engine based on said attributive value.

2. A fuel control system as defined in claim 1, and further comprising purge control means for controlling the amount of a purge gas delivered into an intake system of the engine during execution of the air-to-fuel ratio feedback control, wherein said fuel control value determination means estimates concentration of fuel of the purge gas based on the attributive value and determines said fuel control value based on said concentration of fuel of said purge gas.

3. A fuel control system as defined in claim 1, wherein said target air-to-fuel ratio is an ideally combustible air-to-fuel ratio for a stoichiometric air-fuel mixture.

4. A fuel control system as defined in claim 2, wherein said determination means determines said attributive value based on a value attributive to a change in said air-to-fuel ratio feedback control value between adjacent said reversal.

5. A fuel control system as defined in claim 2, wherein said determination means establishes a fixed value as said attributive value when an actual air-to-fuel ratio is on one side of a rich side providing a rich air-fuel mixture and a lean side providing a lean air-fuel mixture.

6. A fuel control system as defined in claim 2, wherein said fuel control value determination means estimates concentration of fuel of said purge gas based on said attributive value after rarefying said purge gas based on said attributive value when said attributive value is greater than an upper specified level or after enriching said purge gas based on said attributive value when said attributive value is less than a lower specified level.

7. A fuel control system as defined in claim 2, wherein said target air-to-fuel ratio is an ideally combustible air-to-fuel ratio for a stoichiometric air-fuel mixture.

8. A fuel control system as defined in claim 4, wherein said determination means determines an average of air-to-fuel ratio feedback control values before said reversal as said attributive value.

9. A fuel control system as defined in claim 4, wherein said determination means establishes a fixed value as said attributive value when an actual air-to-fuel ratio is on one side of a rich side providing a rich air-fuel mixture and a lean side providing a lean air-fuel mixture.

10. A fuel control system as defined in claim 6, wherein said fuel control value determination means estimates concentration of fuel of said purge gas based on said attributive value without changing said purge gas when said attributive value is between said upper specified level and said lower specified level.

11. A fuel control system as defined in claim 6, wherein said fuel control value determination means estimates concentration of fuel of said purge gas based on said attributive value with a gain and increasing said gain with an increase in said attributive value.

12. A fuel control system as defined in claim 8, wherein said determination means establishes a fixed value as said attributive value when an actual air-to-fuel ratio is on one side of a rich side providing a rich air-fuel mixture and a lean side providing a lean air-fuel mixture.

13. A fuel control system as defined in claim 10, wherein said fuel control value determination means estimates concentration of fuel of said purge gas based on said attributive value with a gain and increasing said gain with an increase in said attributive value.

14. A fuel control system for an automobile engine for executing air-to-fuel ratio feedback control to feedback control said amount of fuel delivered to the engine based on an air-to-fuel ratio feedback control value so as to deliver a target air-to-fuel ratio, said fuel control system comprising:

determination means for determining an attributive value relating to a ratio of fuel to air in a purge gas based on an attributive value relating to a change in an air-to-fuel ratio feedback control value between a last reversal of said air-to-fuel feedback control value from an increasing tendency to a decreasing tendency and a reversal of said air-to-fuel feedback control value from a decreasing tendency to an increasing tendency subsequent to said last reversal; and fuel control value determination means for determining a fuel control value for controlling the amount of fuel delivered to the engine based on said attributive value relating to said ratio of fuel to air in a purge gas.

15. A fuel control system as defined in claim 14, and further comprising purge control means for controlling the amount of a purge gas delivered into an intake system of the engine during execution of the air-to-fuel ratio feedback control, wherein said fuel control value determination means estimates concentration of fuel of said purge gas based on said attributive value of said ratio of fuel to air in an air intake system deviation.

16. A fuel control system as defined in claim 14, wherein said determination means determines an average of an air-to-fuel ratio feedback control at a last reversal of said air-to-fuel feedback control value from an increasing tendency to a decreasing tendency and an air-to-fuel ratio feedback control value at a reversal of said air-to-fuel feedback control value from a decreasing tendency to an increasing tendency subsequent to said last reversal.

17. A fuel control system as defined in claim 15, wherein said fuel control value determination means makes determination of a learning value for learning concentration of fuel of said purge gas based on said attributive value of said ratio of fuel to air in an air intake system with a gain and increasing said gain with an increase in said attributive value of said ratio of fuel to air in an air intake system.

18. A fuel control system as defined in claim 15, wherein said determination means determines an average of an air-to-fuel ratio feedback control at a last reversal of said air-to-fuel feedback control value from an increasing tendency to a decreasing tendency and an air-to-fuel ratio feedback control value at a reversal of said air-to-fuel feedback control value from a decreasing tendency to an increasing tendency subsequent to said last reversal.

19. A fuel control system as defined in claim 17, wherein said fuel control value determination means changes said air-to-fuel ratio feedback control value by a difference in said learning value before and after said determination of said learning value in one step.

20. A fuel control system as defined in claim 17, wherein said determination means determines an average of an air-to-fuel ratio feedback control at a last reversal of said air-to-fuel feedback control value from an increasing tendency to a decreasing tendency and an air-to-fuel ratio feedback control value at a reversal of said air-to-fuel feedback control value from a decreasing tendency to an increasing tendency subsequent to said last reversal.

21. A fuel control system as defined in claim 19, wherein said determination means determines an average of an air-to-fuel ratio feedback control at a last reversal of said air-to-fuel feedback control value from an increasing tendency to a decreasing tendency and an air-to-fuel ratio feedback control value at a reversal of said air-to-fuel feedback control value from a decreasing tendency to an increasing tendency subsequent to said last reversal.

22. A fuel control system for an automobile engine for executing air-to-fuel ratio feedback control to feedback control the amount of fuel delivered to the engine based on an air-to-fuel ratio feedback control value so as to deliver a target air-to-fuel ratio, said fuel control system comprising:

purge control means for controlling a purge valve between an intake system and a fuel tank to deliver a target rate of a purge gas into the intake system;

determination means for determining an attributive value relating to a ratio of fuel to air in a purge gas based on said air-to-fuel ratio feedback control values at adjacent reversal of said air-to-fuel ratio feedback control value between a downward tendency and an upward tendency; and fuel control means for determining concentration of fuel of said purge gas based on said attributive value, determining a content of fuel of said purge gas based on said target rate of said purge gas and said concentration of fuel of said purge gas, and decreasing the amount of fuel delivered to the engine by said content of fuel of said purge gas.

23. A fuel control system for an automobile engine for executing air-to-fuel ratio feedback control to feedback control an amount of fuel delivered to the engine based on an air-to-fuel ratio feedback control value so as to deliver a target air-to-fuel ratio, said fuel control system comprising:

a fuel injector operative to deliver fuel;

an air-fuel ratio sensor disposed in an exhaust system for detecting an actual air-to-fuel ratio;

a purge control system operative to purge evaporated fuel from a fuel tank into an intake passage; and a controller for determining a feedback control correction value based on a deviation of said actual air-to-fuel ratio from a target air-to-fuel ratio with which said air-to-fuel ratio is increased while said actual air-to-fuel ratio is smaller than said target air-to-fuel ratio and is decreased while said actual air-to-fuel ratio is greater than said target air-to-fuel ratio so as thereby to bring said actual air-to-fuel ratio to said target air-to-fuel ratio and determining an attributive value relative to an air-to-fuel ratio due to an amount of purged evaporated fuel based on said feedback control correction value at a time of reversal of said feedback control correction value between increasing and decreasing and correcting said amount of fuel according to said attributive value.

* * * * *